US006524387B2

(12) United States Patent
Arslanouk et al.

(10) Patent No.: US 6,524,387 B2
(45) Date of Patent: Feb. 25, 2003

(54) POWDER FEED APPARATUS AND PROCESS FOR THE APPLICATION OF A THERMOPLASTIC RESIN ONTO A FASTENER

(75) Inventors: Mahmoud Arslanouk, Haledon, NJ (US); Anthony DiMaio, Haverhill, MA (US)

(73) Assignee: Nylon Corporation, MaComb, MI (US)

( * ) Notice: Subject to any disclaimer, the term of this patent is extended or adjusted under 35 U.S.C. 154(b) by 0 days.

(21) Appl. No.: 09/298,124

(22) Filed: Apr. 23, 1999

(65) Prior Publication Data

US 2001/0054378 A1 Dec. 27, 2001

(51) Int. Cl.[7] ..... B05B 3/00; B05C 5/00

(52) U.S. Cl. ..... 118/308; 118/319; 118/320; 118/322; 118/324

(58) Field of Search ..... 427/195; 118/308, 118/319, 320, 322, 324, 326, 50

(56) References Cited

U.S. PATENT DOCUMENTS

| | | | | |
|---|---|---|---|---|
| 3,291,631 A | | 12/1966 | Smith | |
| 3,452,714 A | | 7/1969 | Burke et al. | |
| 3,760,928 A | | 9/1973 | Galitz | |
| 3,777,874 A | | 12/1973 | Birckhead | |
| 3,791,842 A | | 2/1974 | Neal | |
| 3,830,902 A | | 8/1974 | Barnes | |
| 3,975,787 A | | 8/1976 | Newnom | |
| 4,060,868 A | | 12/1977 | Axvig et al. | |
| 4,309,787 A | | 1/1982 | Lapohn | |
| 4,775,555 A | | 10/1988 | Duffy | |
| 4,820,235 A | | 4/1989 | Weber et al. | |
| 4,842,890 A | | 6/1989 | Sessa et al. | |
| 4,865,881 A | | 9/1989 | Sessa et al. | |
| 5,141,375 A | | 8/1992 | Pollizzi | |
| 5,141,771 A | * | 8/1992 | DiMaio et al. | 118/308 |
| 5,143,126 A | | 9/1992 | Boesch et al. | |
| 5,148,378 A | | 9/1992 | Shibayama et al. | |
| 5,262,197 A | | 11/1993 | Pollizzi | |
| 5,306,346 A | | 4/1994 | DiMaio et al. | |
| 5,362,327 A | | 11/1994 | Sessa et al. | |
| 5,403,624 A | | 4/1995 | DiMaio et al. | |
| 5,537,925 A | | 7/1996 | Secor et al. | |
| 5,571,323 A | | 11/1996 | Duffy et al. | |
| 5,607,720 A | | 3/1997 | Wallace et al. | |
| 5,656,325 A | | 8/1997 | Wallace | |
| 5,718,945 A | | 2/1998 | Arslanouk | |
| 5,836,721 A | | 11/1998 | Wallace | |

* cited by examiner

*Primary Examiner*—Richard Crispino
*Assistant Examiner*—Yewebdar Tadesse
(74) *Attorney, Agent, or Firm*—Niro, Scavone, Haller & Niro

(57) ABSTRACT

An apparatus and method for use with powdered resin feeders provides a continuous stream of powder to a plurality of threaded or non-threaded fasteners. In one preferred embodiment, the apparatus generates a gravity induced powder stream at the free end of a discharge conduit which is intersected by a series of fasteners carried on a conveyor. A vacuum nozzle is positioned adjacent to the powder stream and the conveyor. Both the vacuum nozzle and the free end of the discharge conduit are adjustably positionable relative to the path of the fasteners carried on the conveyor.

13 Claims, 1 Drawing Sheet

POWDER FEED APPARATUS AND PROCESS FOR THE APPLICATION OF A THERMOPLASTIC RESIN ONTO A FASTENER

BACKGROUND OF THE INVENTION

The present invention relates to specially processed fasteners, and, more particularly, to apparatus and methods for the manufacture of fasteners having a resin material applied to achieve a self-locking or sealing function or for other purposes well known in the art.

There are a variety of ways to apply a resin coating to a fastener. Many devices and methods have been developed and directed toward this purpose. One common technique involves the deposition of powdered resin by passing the fastener through a gravity induced cascade of the resin as shown in prior art patents such as U.S. Pat. No. 3,830,902 (Barnes) and U.S. Pat. No. 3,286,964 (Burgess). Another technique employs entrainment of the powdered resin in an air stream and spraying the resulting air entrained powder through a nozzle toward a passing fastener as shown in U.S. Pat. No. 3,498,352 (Duffy). To prevent waste of the powdered resin that bypasses the fastener during the referenced processes, others have proposed the use of vacuum devices that collect and recirculate the excess powder such as U.S. Pat. No. 5,836,721 (Wallace).

Among the known disadvantages of the gravity feed process is the lack of precision in the deposition of the powdered resin. An excessive powder flow rate is commonly induced to insure that at least the minimum required quantity of powder is applied to the fastener, resulting in an undesirable level of waste or excessive recirculation of the resin which can diminish the quality of the resin materials. Entrained air spraying processes reduce waste and improve precision, but with a concomitant increase in cost. Use of the spraying process requires a higher energy demand to generate the pressurized air stream and to preheat the fasteners in advance of the powder application. Moreover, the compressed air typically used in such processes is preferably cleaned to remove moisture and oil to minimize powder contamination. The preheated fastener required by the spraying process creates a condition where the powder coating is instantly bonded to the fastener, thereby preventing removal of the resin inadvertentaly deposited onto areas of the fastener where the coating is not required or desired.

It would be advantageous, therefore, to have a powder application system for applying coatings on fasteners having the cost benefit of the gravity feed process while retaining a measure of the precision of the air spray process. It would further be advantageous to retain the ability to clean excess powder from the fastener prior to heat bonding.

SUMMARY OF THE INVENTION

The present invention is directed to an apparatus and a method for applying a powdered resin coating to a fastener that incorporates a combination of adjustably positionable gravity deposition and vacuum recirculation components so as to overcome the limitations of the prior art.

The present invention is, therefore, an apparatus and a method for applying a resin coating to a fastener. A reservoir for the powdered resin materials is provided with a discharge means that has an adjustably positionable free end. The discharge means or conduit forms a gravity induced cascade for feeding the resin material onto the fastener. Variation in the dimensions of the discharge conduit allows for a variety of configurations for the cascading powder stream leaving the free end. Fasteners are passed through the powder stream by conveyor means. Adjacent to the powder stream and the conveyor carried fasteners, an adjustably positionable vacuum nozzle is provided to collect excess resin. The ability to adjust the spatial and positional relationship of the discharge conduit and the vacuum nozzle allows more precise control over the location and amount of powdered resin material that is deposited on the fastener. Following the powder deposition and collection steps, the fasteners are passed through a heating means to permanently fuse the resin material to the fastener.

In a preferred embodiment, the conveyor means is a rotating carousel with a means for rotating individual fasteners as they pass through the powder stream. One potential means for rotating the fasteners involves the application of vertical posts to the rotating carousel. The posts can be adjustably spaced to accommodate a variety of fastener sizes. A fastener is placed in a fixed position at the top of each post, and the rotation is accomplished by means that make the posts themselves rotate.

Another preferred feature of the invention is the inclusion of a means for vibrating the reservoir to assist in control of the feed rate of the resin material into the discharge conduit. The discharge conduit may also include an adjustable input baffle at the head of the discharge conduit to provide for further control of the feed rate. Additionally, a means for adjusting the negative pressure on the vacuum nozzle provides still further control over the removal of excess deposited resin material on the fasteners.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

DESCRIPTION OF THE PREFERRED EMBODIMENTS

Figure 1:
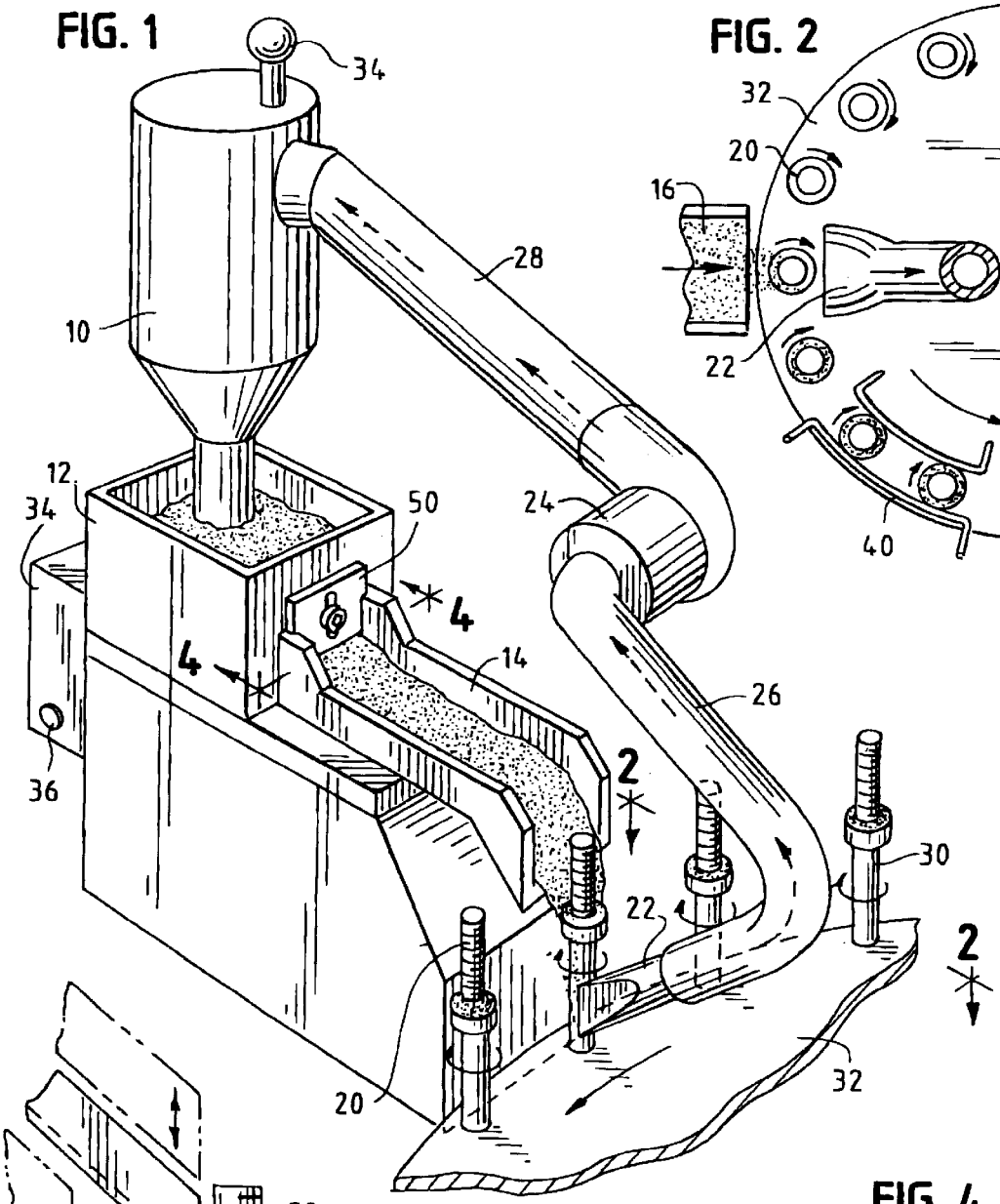
FIG. 1 is a perspective view of a preferred apparatus for practicing the present invention.

FIG. 1 is a perspective drawing that depicts the general features of the invention. Powder hopper 10 supplies powdered resin material to reservoir 12. When the apparatus is in operation, the resin material flows by vibrational actuation and gravity from the reservoir 12 through the port 18 and into the discharge conduit 14. The discharge conduit 14 terminates at a free end 16. When the resin material passes over the free end 16, a free falling cascade or stream of the powdered resin is created that has a lateral length equivalent to the width of the discharge conduit 14. It is acknowledged, therefore, that the feed rate of the resin material and the contact time between the fastener 20 and the resin material are both, in part, a function of the width of the discharge conduit 14.

Figure 2:
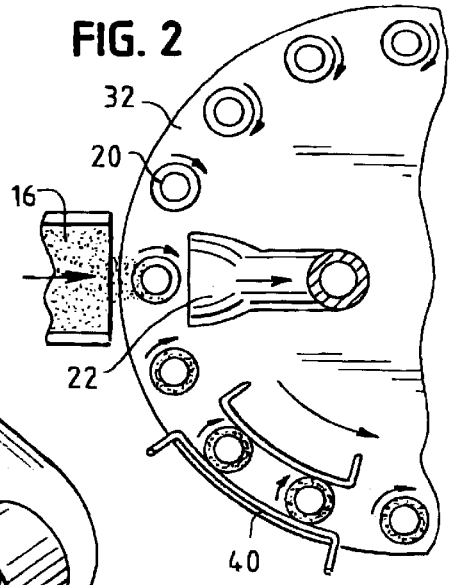
FIG. 2 is a partial plan view of the apparatus shown in FIG. 1 taken at line 2—2 of FIG. 1, showing the relationship between the discharge conduit and the vacuum nozzle with respect to fasteners positioned on an associated rotating carousel conveyor.

In one embodiment, illustrated in FIG. 1 and FIG. 2, fasteners 20 are passed along the length of the cascade by a conveyor means such as horizontally rotating carousel 32. The fasteners 20 are held in place on carousel 32 by magnetic vertical posts 30. Alternatively, a vacuum system may be disposed within the posts to hold non-magnetic parts in proper position throughout the process. The spacing of vertical posts 30 may be adjustable to accommodate a variety of fastener shapes and sizes. When a carousel 32 is used as the conveyor means, the cascade of the coating material is positioned tangential to the arc of the conveyor path as shown in FIG. 2. As each fastener 20 passes through the cascade falling from free end 16, resin material is deposited. The sequence of the contemplated coating method requires that the fasteners 20 pass between the discharge end portion 16 and the coincident vacuum nozzle 22 prior to entering a heating station 40. Arrows A at each fastener 20 depict rotational movement which is desirable when a circumferential coating is required. In a preferred embodiment, the fastener 20 is rotated provided by rotating vertical post 30. A variety of apparatus are well known to those skilled in the art to achieve rotation of individual parts 30. Examples of such mechanisms are illustrated in U.S. Pat. No. 4,775,555 and U.S. patent application Ser. No. 08/779,684 filed Jan. 7, 1997, the disclosures of which are incorporated herein by reference.

Figure 3:
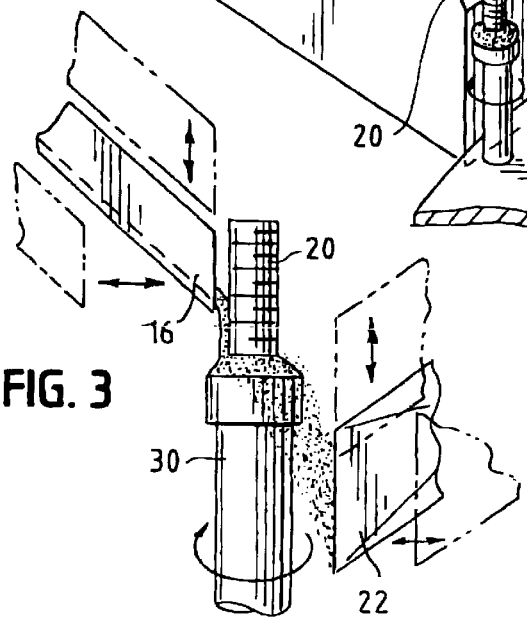
FIG. 3 is a partial side elevation of the apparatus shown in FIG. 1 indicating the adjustable relationship between the free end of the discharge conduit and the free end of the vacuum nozzle with respect to the fastener.

A vacuum nozzle 22 is positioned adjacent to free end 16 such that, when the conveyor means moves fastener 20 into communication with the resin material stream, fastener 20 is positioned between the free end 16 of the discharge conduit 14 and the vacuum nozzle 22. FIG. 3 shows the positional relationship between the free end 16, the fastener 20 and the vacuum nozzle 22. An important feature of the invention is that both the discharge conduit free end 16 and the vacuum nozzle 22 are adjustably positionable with respect to the fastener 20. FIG. 3 shows the positional adjustment of the free end 16 and the nozzle 22 in both horizontal and vertical planes. Such adjustment can be achieved using manually adjustable mechanisms or motor driven assemblies well known to those of skill in the art. Typically, vertical and/or horizontal displacements ranging from a few thousandths of an inch up to about one to two inches will be sufficient to accommodate a full range of resin coating applications. The ability to control both horizontal and vertical positioning during coating application allows more precise location of the resin material on a specific portion of a fastener 20 and to more precisely control the thickness of the coating to be applied. The vacuum nozzle may also communicate with a variable speed fan 24 by means of a vacuum conduit 26. Adjusting the speed of the fan 24 may be used in conjunction with adjustment of the nozzle 22 position to control the amount of resin material deposited and retained on a fastener 20.

The resin material collected by the vacuum nozzle 22 is transported back to the reservoir 12 by means of a recirculation system. Fan 24 draws excess coating material from the nozzle 22 into the vacuum conduit 26 and through conduit 28 into the supply hopper 10. Hopper 10 has a conical bottom with an open access to the reservoir 12. A vent 34 at the top of tank 10 exhausts the air flow to atmosphere.

After fasteners 20 pass through the cascade of coating material between the free end 16 of the discharge conduit 14 and the vacuum nozzle 22, they are transported via carousel 32 through a heating station such as induction coil 40 to permanently bond the coating to the fastener. Other conveyors well known in the art, as disclosed for example in U.S. Pat. Nos. 3,787,222; 4,060,868; and 4,842,890, may also be used. The disclosure of this patent is also incorporated herein by reference.

Figure 4:
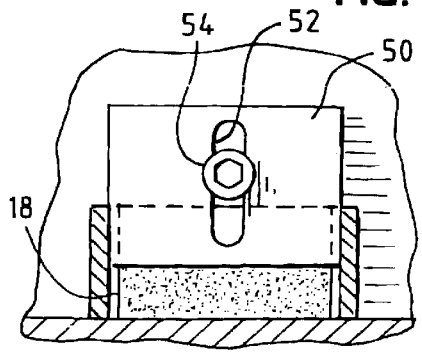
FIG. 4 is a cross section view taken at section line 4—4 of FIG. 1, showing the adjustable port between the reservoir and the discharge conduit.

In one embodiment of the invention illustrated in FIG. 4, the interface between the reservoir 12 and the upstream end of the discharge conduit 14 is comprised of an adjustable input port 18. The baffle plate 50 defines input port 18 and is sized to overlie the reservoir opening. Plate 50 is held in place laterally by slotted channels formed in the side walls of discharge conduit 14. Plate 50 is vertically adjustable and may be maintained in position by retaining bolt 54 disposed within adjustment slot 52.

An additional measure of flow rate control can be achieved by adjustment of a variable vibrating means. The vibration system, designated generally as 34, benefits the operation of the resin feed mechanism not only by providing improved discharge rate control, but also by breaking up agglomerations of the resin materials. The vibration system 34 includes a control device 36 operable to regulate the amplitude and frequency of the vibration. The ability to adjust the speed of vibration allows more precise control of the resin material discharge rate from reservoir 12.

The apparatus and method of the present invention are ideally suited for the application, as depicted, of powdered resin material at the junction of a fastener's head and shank. Typically, such powdered resins may comprise polyolefins which, after curing, form a resilient and pliable, integral seal, as more fully disclosed in U.S. Pat. No. 5,141,375, which is incorporated herein by reference. When applying such powdered polyolefin resins in the practice of the present invention, it has been found that the free end 16 of discharge conduit 14 should be positioned about ½ inch above and about ⅛ inch horizontally from the juncture of the shank and head of the fastener. The vacuum nozzle, on the other hand is preferably about ⅜ inches below and about 3/16 inches horizontally from that same fastener juncture. Also, the following process parameters have been found suitable for this process:

- powder discharge conduit width—2 inches
- fastener rotation within discharge stream—about 3 revolutions
- powder discharge flow rate—about 2 oz./min.
- linear speed of fasteners through powder stream—about 1 in./sec.
- temperature of fastener exiting heating station—about 500° F.
- vacuum air flow at vacuum nozzle—about 1500 FPM
- vacuum air flow at fastener—about 950 FPM Increasing the vacuum generated at nozzle 22 or positioning nozzle 22 closer to the fastener (either vertically or horizontally) will result in deposition of less powdered resin on the fastener.

Of course, it should be understood that various changes and modifications to the preferred embodiments described herein will be apparent to those skilled in the art. Such changes and modifications can be made without diminishing its attendant advantages. It is therefore intended that such changes and modifications be covered by the following claims:

We claim:

1. An apparatus for the application of a resin coating to fasteners, comprising:

a powdered resin reservoir having a discharge conduit terminating in a free end so that powdered resin discharged from the reservoir falls under the force of gravity in a falling powdered resin stream of predetermined configuration;

a conveyor for supporting and transporting a plurality of the fasteners through said resin stream;

a vacuum nozzle positioned adjacent to the free end of the discharge conduit so that, as the conveyor moves the fasteners through the falling resin stream, each of the fasteners is positioned between the free end of the discharge conduit and the vacuum nozzle, the vacuum nozzle being adjustably positionable relative to the path of travel of the fasteners through said falling resin stream, the position of the nozzle being adjustable to control the amount of powdered resin retained on the fasteners; and a heater positioned adjacent the conveyor to heat the powdered resin retained on the fasteners thereby fusing the resin into a coherent coating on the fastener.

2. The apparatus of claim 1 wherein the vacuum nozzle is adjustable both horizontally and vertically relative to the path of travel of the fasteners through the resin stream.

3. The apparatus of claim 1 wherein the flow rate of air drawn into the vacuum nozzle is adjustable to further control the amount of resin retained on the fasteners.

4. The apparatus of claim 1 wherein the powdered resin reservoir is vibrated to discharge powdered resin and the amount of resin discharged is controlled by adjustment of the reservoir vibration.

5. The apparatus of claim 1 wherein the conveyor comprises a rotating carousel.

6. The apparatus of claim 1 wherein the conveyor comprises one or more linear belts.

7. The apparatus of claim 1 wherein the conveyor includes means for rotating the fastener as it travels through said resin stream.

8. The apparatus of claim 1 wherein the conveyor comprises a generally horizontally rotating carousel having a plurality of vertically upstanding posts, each post adapted to support an individual fastener, whereby the path of travel of the fasteners defines a generally horizontal arcuate path.

9. The apparatus of claim 8 wherein the posts rotate and thereby rotate the fasteners as they pass through said resin stream.

10. The apparatus of claim 1 wherein the free end of said discharge conduit is configured to form an elongated powder stream and the fasteners carried by the conveyor pass along the elongated powder stream.

11. The apparatus of claim 10 wherein the free end of said discharge conduit and the vacuum nozzle are positioned on opposite sides of the path of travel of the fasteners carried by the conveyor.

12. The apparatus of claim 1 wherein the free end of said discharge conduit is adjustably positionable relative to the path of travel of the fasteners carried by the conveyor.

13. The apparatus of claim 1 wherein the powdered resin reservoir includes an adjustable input port to the discharge conduit.

* * * * *

UNITED STATES PATENT AND TRADEMARK OFFICE

CERTIFICATE OF CORRECTION

PATENT NO. : 6,524,387 B2
DATED : February 25, 2003
INVENTOR(S) : Mahmound Arslanouk It is certified that error appears in the above-identified patent and that said Letters Patent is hereby corrected as shown below:

Title page,
Item [73], Assignee, delete "Nylon" and replace with -- Nylok --.

Signed and Sealed this

Thirteenth Day of January, 2004

JON W. DUDAS
*Acting Director of the United States Patent and Trademark Office*